US011817248B2

(12) United States Patent
Isobe et al.

(10) Patent No.: US 11,817,248 B2
(45) Date of Patent: Nov. 14, 2023

(54) SURFACE MOUNT INDUCTOR AND METHOD OF MANUFACTURING SURFACE MOUNT INDUCTOR

(71) Applicant: Murata Manufacturing Co., Ltd., Kyoto-fu (JP)

(72) Inventors: Hideyuki Isobe, Nagaokakyo (JP); Masaki Kitajima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 932 days.

(21) Appl. No.: 16/544,505

(22) Filed: Aug. 19, 2019

(65) Prior Publication Data

US 2020/0090850 A1 Mar. 19, 2020

(30) Foreign Application Priority Data

Sep. 19, 2018 (JP) ..... 2018-175175

(51) Int. Cl.
*H01F 27/29* (2006.01)
*H01F 27/02* (2006.01)
(Continued)

(52) U.S. Cl.
CPC ..... *H01F 27/022* (2013.01); *H01F 17/04* (2013.01); *H01F 27/2885* (2013.01);
(Continued)

(58) Field of Classification Search
CPC .... H01F 27/022; H01F 17/04; H01F 27/2885; H01F 27/292; H01F 27/361;
(Continued)

(56) References Cited

U.S. PATENT DOCUMENTS

2004/0189430 A1* 9/2004 Matsutani ..... H01F 27/027 336/83
2004/0246090 A1 12/2004 Matsutani et al.
(Continued)

FOREIGN PATENT DOCUMENTS

CN 1574127 A 2/2005
CN 204668122 U 9/2015
(Continued)

OTHER PUBLICATIONS

An Office Action; "Notice of Reasons for Refusal," mailed by the Japanese Patent Office dated Mar. 23, 2021, which corresponds to Japanese Patent Application No. 2018-175175 and is related to U.S. Appl. No. 16/544,505 with English language translation.

*Primary Examiner* — Tuyen T Nguyen
(74) *Attorney, Agent, or Firm* — Studebaker & Brackett PC

(57) ABSTRACT

A surface mount inductor includes a coil buried in a composite material including a magnetic powder; outer terminals connected to the coil; and a molded body having a metal surface that intersects a winding axis of the coil and including the composite material. A surface mount inductor manufacturing method includes arranging, inside a mold, a metal plate having a shape covering part of a surface of a molded body; arranging a coil and a composite material including a magnetic powder or a preliminary molded body composed of the composite material inside the mold in which the metal plate has been arranged; and forming a molded body in which the coil is buried and that has the metal plate arranged on part of a surface of the molded body by molding the metal plate, the composite material, and the coil inside the mold to be integrated with each other.

7 Claims, 15 Drawing Sheets

(51) Int. Cl.

| | |
|---|---|
| ***H01F 41/00*** | (2006.01) |
| ***H01F 17/04*** | (2006.01) |
| ***H01F 27/28*** | (2006.01) |
| ***H01F 27/36*** | (2006.01) |

(52) U.S. Cl.
CPC ..... *H01F 27/292* (2013.01); *H01F 27/361* (2020.08); *H01F 27/366* (2020.08); *H01F 41/005* (2013.01); *H01F 2017/048* (2013.01)

(58) Field of Classification Search
CPC ..... H01F 27/366; H01F 41/005; H01F 2017/048; H01F 2017/008; H01F 27/2852
See application file for complete search history.

(56) References Cited

U.S. PATENT DOCUMENTS

| | | | | |
|---|---|---|---|---|
| 2017/0309394 | A1* | 10/2017 | Blow | H01F 27/361 |
| 2018/0166211 | A1 | 6/2018 | Takatsuji | |

FOREIGN PATENT DOCUMENTS

| | | | | |
|---|---|---|---|---|
| CN | 108183017 | A | 6/2018 | |
| EP | 2704165 | A1 * | 3/2014 | H01F 27/2847 |
| JP | 2005-005287 | A | 1/2005 | |
| JP | 2012-138535 | A | 7/2012 | |
| JP | 2018-098270 | A | 6/2018 | |

* cited by examiner

FIG. 4A1
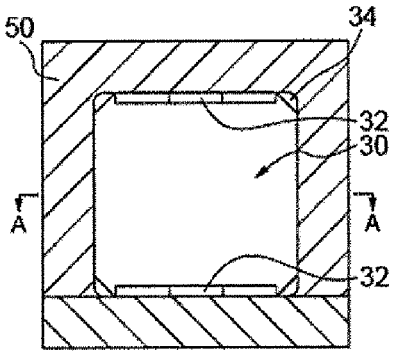
FIG. 4A2
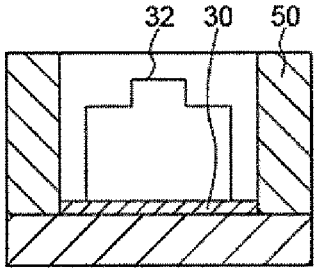
FIG. 4B1
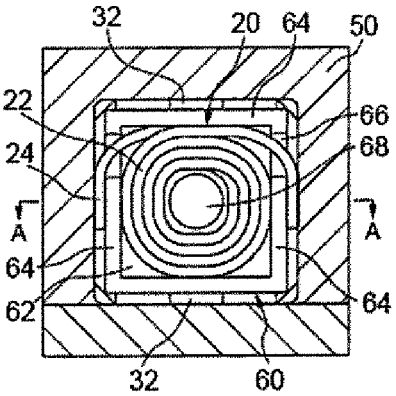
FIG. 4B2
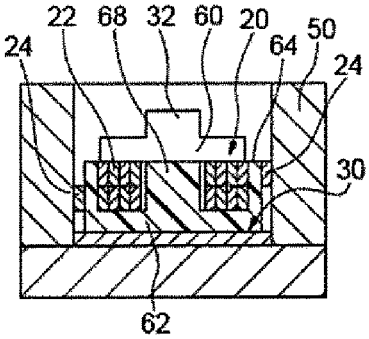
FIG. 4C1
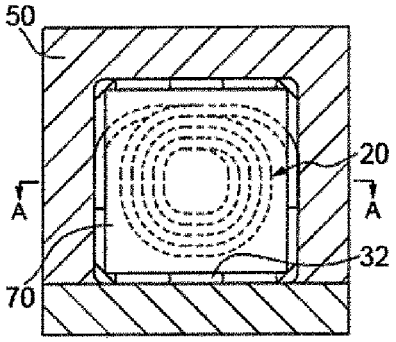
FIG. 4C2
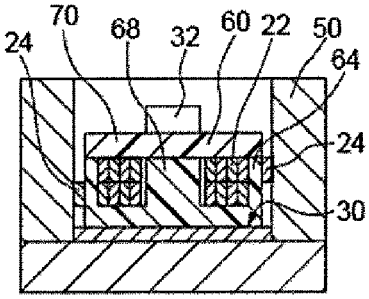

FIG. 8A1
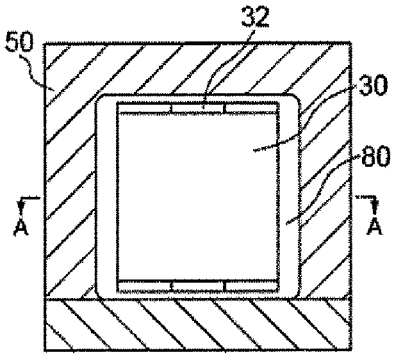
FIG. 8A2
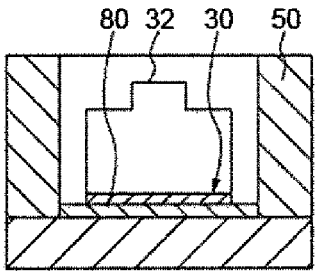
FIG. 8B1
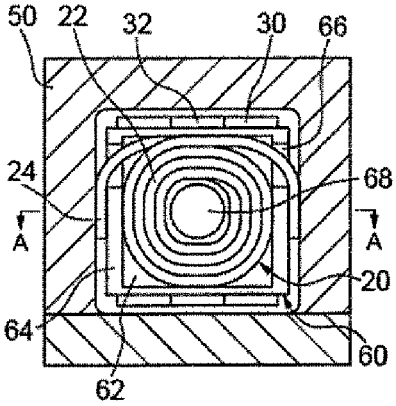
FIG. 8B2
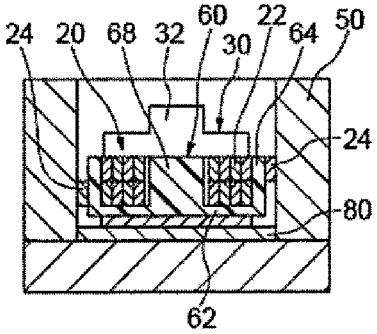
FIG. 8C1
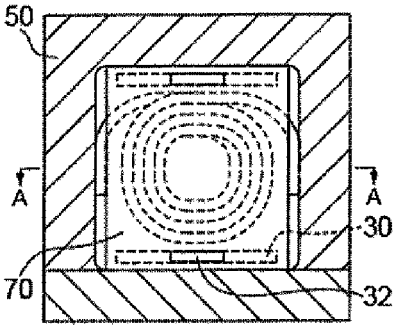
FIG. 8C2
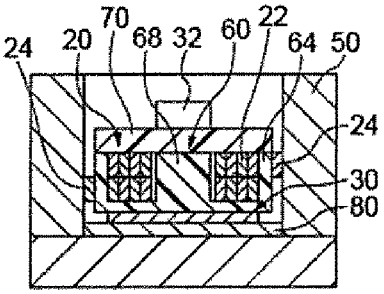

FIG. 12A1
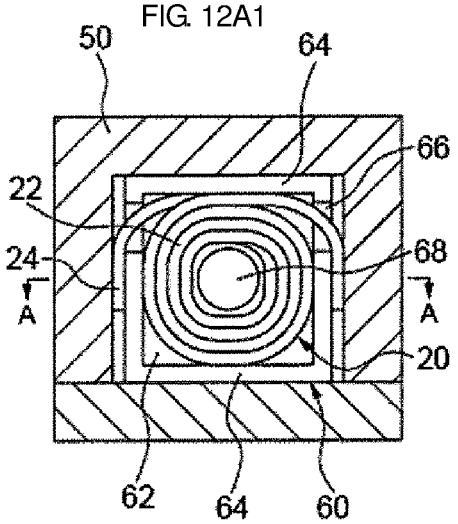
FIG. 12A2
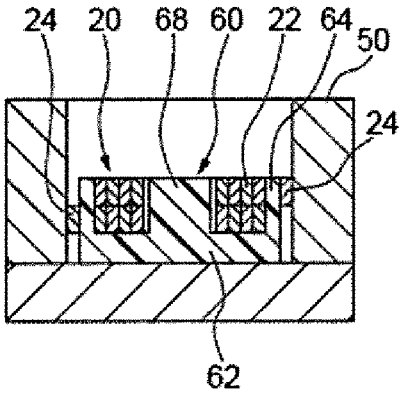
FIG. 12B1
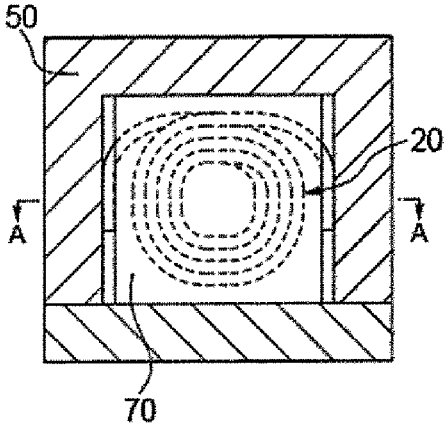
FIG. 12B2
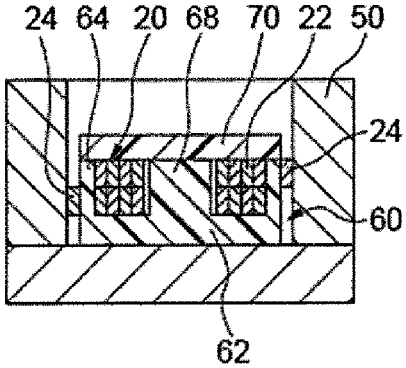

FIG. 15A1
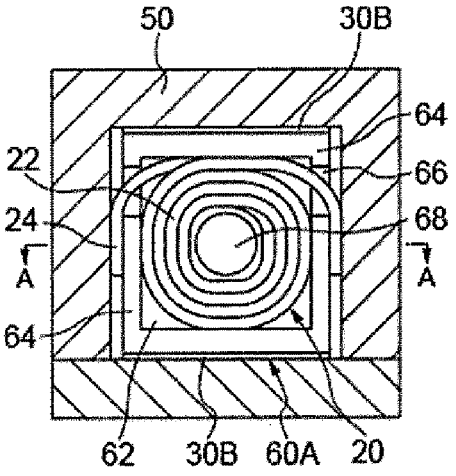
FIG. 15A2
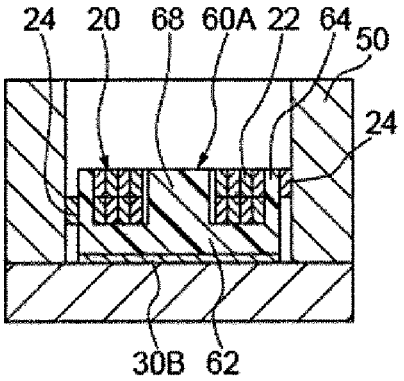
FIG. 15B1
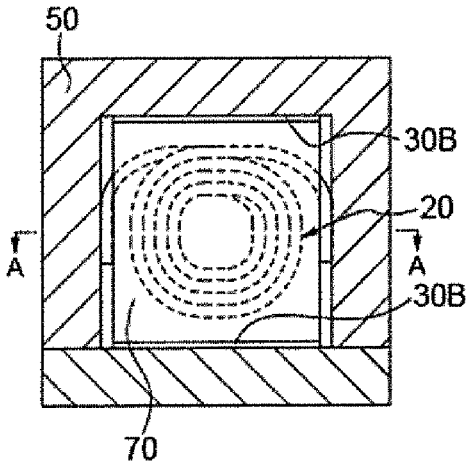
FIG. 15B2
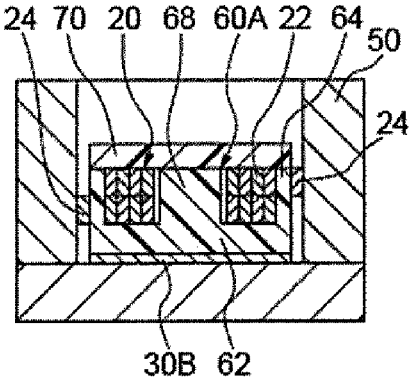

SURFACE MOUNT INDUCTOR AND METHOD OF MANUFACTURING SURFACE MOUNT INDUCTOR

CROSS-REFERENCE TO RELATED APPLICATION

This application claims benefit of priority to Japanese Patent Application No. 2018-175175, filed Sep. 19, 2018, the entire content of which is incorporated herein by reference.

BACKGROUND

Technical Field

The present disclosure relates to a surface mount inductor and a method of manufacturing a surface mount inductor.

Background Art

A shielded inductor is known that includes a molded body in which a coil is buried and a shield member that includes an electrically conductive material and covers a surface of the molded body as described, for example, in US Patent Application Publication No. 2017/0309394. The shield member is connected to ground in this shielded inductor and as a result radiation noise from the inductor is suppressed.

In this shielded inductor of the related art, the shield member is formed by covering the molded body, which has the coil built into the inside thereof, with a metal plate and then crimping the metal plate. Consequently, radiation noise leakage may occur due to close contact between the molded body and the shield member being unstable and a withstand voltage characteristic may be reduced due to the distance between the shield member and an outer terminal connected to the coil being smaller than a prescribed distance due to variations in the position of the shield member.

SUMMARY

Accordingly, the present disclosure provides a surface mount inductor that is excellent in terms of close contact between a molded body and a shield member, and to provide a method of manufacturing the surface mount inductor.

A surface mount inductor according to a first embodiment of the present disclosure includes a coil that is buried in a composite material that includes a magnetic powder; outer terminals that are connected to the coil; and a molded body that has a metal surface that intersects a winding axis of the coil and includes the composite material.

In addition, a surface mount inductor manufacturing method according to a second embodiment of the present disclosure includes arranging, inside a mold, a metal plate having a shape so as to be able to cover part of a surface of a molded body; arranging a coil and a composite material including a magnetic powder or a preliminary molded body composed of the composite material inside the mold in which the metal plate has been arranged; and forming a molded body in which the coil is buried and that has the metal plate arranged on part of a surface of the molded body by molding the metal plate, the composite material, and the coil inside the mold so that the metal plate, the composite material, and the coil are integrated with each other.

A surface mount inductor manufacturing method according to a third embodiment of the present disclosure includes arranging, inside a mold, a coil and a composite material including a magnetic powder or a preliminary molded body composed of the composite material; forming a molded body in which the coil is buried by molding the composite material and the coil inside the mold so that the composite material and the coil are integrated with each other; and forming a metal film on a surface of the molded body.

A surface mount inductor manufacturing method according to a fourth embodiment of the present disclosure includes arranging, inside a mold, a coil and a preliminary molded body obtained by preliminarily molding a composite material including a magnetic powder and forming a metal film on a surface thereof; and forming a molded body in which the coil is buried and that has the metal film on a surface thereof by molding the preliminary molded body and the coil inside the mold so that the preliminary molded body and the coil are integrated with each other.

According to the present disclosure, there can be provided a surface mount inductor that is excellent in terms of close contact between a molded body and a shield member, and a method of manufacturing the surface mount inductor.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIGS. 4A1 to 4C2 illustrate schematic plan views and schematic sectional views for explaining a method of manufacturing the surface mount inductor of example 1;

FIGS. 8A1 to 8C2 illustrate schematic plan views and schematic sectional views for explaining a method of manufacturing the surface mount inductor of example 3;

FIGS. 12A1 to 12B2 illustrate schematic plan views and schematic sectional views for explaining a method of manufacturing the surface mount inductor of example 6;

FIGS. 15A1 to 15B2 illustrate schematic plan views and schematic sectional views for explaining another method of manufacturing the surface mount inductor of example 6;

DETAILED DESCRIPTION

Figure 1:
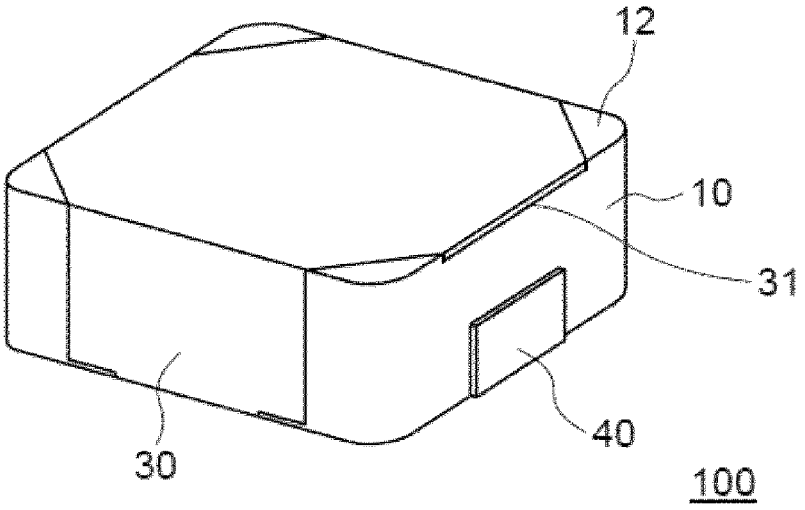
FIG. 1 is a schematic perspective view of a surface mount inductor of example 1 as seen from a top surface side.

A surface mount inductor according to a first embodiment includes a coil that is buried in a composite material that includes a magnetic powder; outer terminals that are connected to the coil; and a molded body that has a metal surface that intersects a winding axis of the coil and includes the composite material. In other words, the surface mount inductor includes a coil; a molded body that includes a composite material including a magnetic powder, that has the coil built into the inside thereof, and that has a metal surface that intersects a winding axis of the coil; and outer terminals that are arranged on a surface of the molded body and are electrically connected to the coil. Leakage of radiation noise from the coil can be effectively suppressed as a result of the molded body having the metal surface that intersects the winding axis of the coil.

The metal surface of the molded body may be arranged such that at least part of the metal surface is exposed at a surface of the molded body. A rear surface side of a metal member constituting the metal surface is buried inside the molded body, and therefore mechanical strength such as vibration resistance and impact resistance is improved in addition to close contact between the metal member and the molded body being further improved. In addition, the shape of the coil inside the molded body can be increased in size as a result of the metal surface being exposed at the surface of the molded body.

The metal surface of the molded body may be arranged on a top surface of the molded body that is on the opposite side from a mounting surface of the molded body and the metal surface may have molded body exposed portions at at least two corners out of the four corners of the top surface. As a result of forming the molded body exposed portions where part of the surface of the molded body is exposed, the area of contact between the metal member constituting the metal surface and the molded body can be increased and consequently close contact between the metal member and the molded body is improved.

The metal surface of the molded body may be arranged so as to extend along the top surface of the molded body, which is on the opposite side from the mounting surface of the molded body, and along a pair of side surfaces of the molded body that are adjacent to the top surface and face each other, and the metal surface of the molded body may have molded body exposed portions that are continuously formed on the top surface and the pair of side surfaces of the molded body. As a result of forming the molded body exposed portions where part of the surface of the molded body is exposed, the area of contact between the metal member constituting the metal surface and the molded body can be increased and consequently close contact between the metal member and the molded body is improved.

The metal surface of the molded body may be buried inside the molded body. Close contact between the metal member and the molded body is further improved by burying the metal member constituting the metal surface in the molded body.

The metal member constituting the metal surface of the molded body may be a metal plate and one surface of the metal plate may be the metal surface. As a result of the metal member constituting the metal surface being a plate, the strength of the metal member is improved and consequently the mechanical strength of the surface mount inductor is further improved.

The metal member constituting the metal surface of the molded body may be a metal film formed on the surface of the molded body and one surface of the metal film may be the metal surface. As a result of the metal member constituting the metal surface being a metal film, the volume of the molded body in the surface mount inductor can be relatively increased and the shape of the coil buried in the molded body can be increased in size.

The metal member constituting the metal surface of the molded body may be metal film and at least part of the metal material constituting the metal film may be buried inside the molded body. Close contact between the metal film and the molded body is further improved in this way.

A surface mount inductor manufacturing method according to a second embodiment includes arranging, inside a mold, a metal plate having a shape so as to be able to cover part of a surface of a molded body; arranging a coil and a composite material including a magnetic powder or a preliminary molded body composed of the composite material inside the mold in which the metal plate has been arranged; and forming a molded body in which the coil is buried and that has the metal plate is arranged on part of a surface of the molded body by molding the metal plate, the composite material, and the coil inside the mold so that the metal plate, the composite material, and the coil are integrated with each other. As a result of the metal plate being formed so as to be integrated with the molded body, there is excellent close contact between the metal plate and the molded body and leakage of radiation noise from the coil is effectively suppressed.

A surface mount inductor manufacturing method according to a third embodiment includes arranging, inside a mold, a coil and a composite material including a magnetic powder or a preliminary molded body composed of the composite material; forming a molded body in which the coil is buried by molding the composite material and the coil inside the mold so that the composite material and the coil are integrated with each other; and forming a metal film on a surface of the molded body. As a result of forming the metal member constituting the metal surface as a metal film, the thickness of the metal member can be made small. Therefore, the volume of the molded body in the surface mount inductor can be relatively increased and the shape of the coil buried in the molded body can be increased in size.

The surface mount inductor manufacturing method may include further molding the molded body on which the metal film has been formed inside the mold. Part of the metal material constituting the metal film formed on the surface of the molded body is buried inside the molded body, and as a result close contact between the metal film and the molded body is further improved.

A surface mount inductor manufacturing method according to a fourth embodiment includes arranging, inside a mold, a coil and a preliminary molded body obtained by preliminarily molding a composite material including a magnetic powder and forming a metal film on a surface thereof; and forming a molded body in which the coil is buried and that has the metal film on a surface thereof by molding the preliminary molded body and the coil inside the mold so that the preliminary molded body and the coil are integrated with each other. As a result of using a preliminary molded body having a metal film, a molded body having a metal surface on a surface thereof and in which a coil is buried can be manufactured with good productivity.

The term "step" used in this specification refers to not only an independent step but also a step that cannot be clearly distinguished from another step so long as the expected aim of that step is achieved. In addition, in the case where there are a plurality of substances corresponding to an individual component in a composition, the amount of component contained in the composition means the total amount of the plurality of substances present in the composition unless otherwise specified. Hereafter, embodiments of the present disclosure will be described on the basis of the drawings. The following embodiments are exemplary examples of a surface mount inductor and a manufacturing method therefor for making the technical ideas of the present disclosure clear, and the present disclosure is not limited to the surface mount inductors and manufacturing methods described below. Members described in the scope of the claims are in no way limited to the members described in the embodiments. In particular, unless specifically stated otherwise, it is not intended that scope of the present disclosure be limited to the dimensions, materials, shapes, relative arrangements, and so forth of constituent components described in the embodiments and these are merely explanatory examples. Identical parts are denoted by identical symbols in the drawings. Taking explanation of important points or ease of understanding into account, the embodiments are described in a separate manner for the sake of convenience, but parts of the configurations illustrated in the different embodiments may be substituted for one another or combined with each other. In example 2 and examples thereafter, description of matters common to example 1 will be omitted and only the differences will be described. In particular, the same operational effects resulting from the same configurations will not be repeatedly described in the individual embodiments.

EXAMPLES

Example 1

Figure 2:
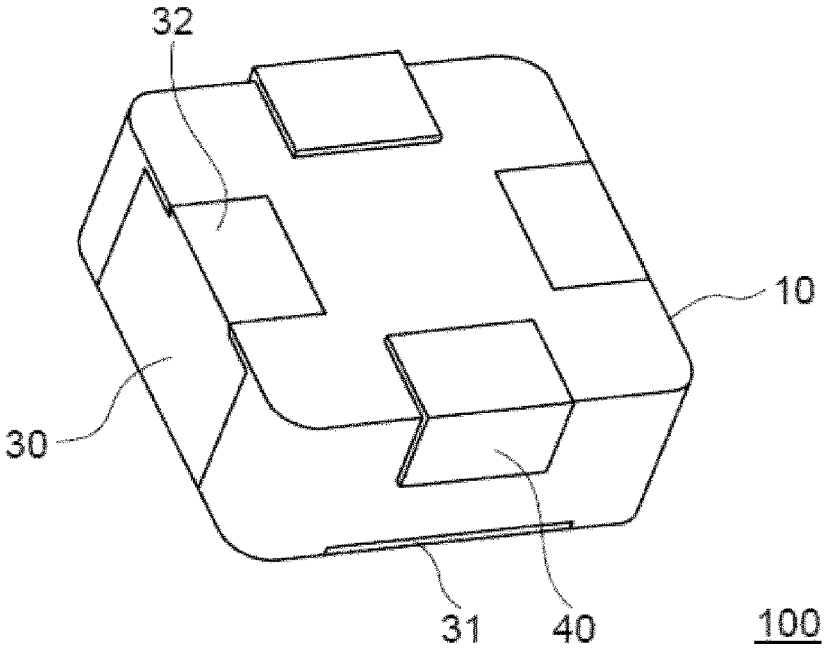
FIG. 2 is a schematic perspective view of the surface mount inductor of example 1 as seen from a mounting surface side.
Figure 3:
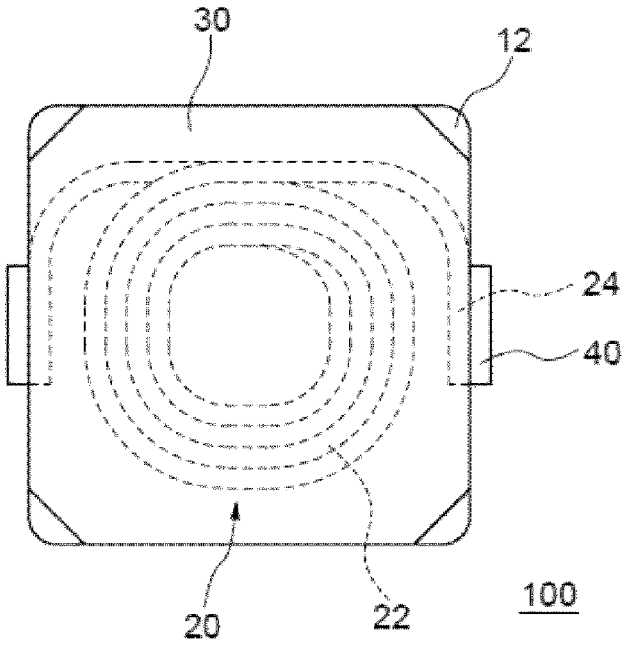
FIG. 3 is a schematic transparent plan view of the surface mount inductor of example 1 as seen from the top surface side.

A surface mount inductor 100 of example 1 will be described while referring to FIGS. 1 to 4C2. FIG. 1 is a schematic perspective view of the surface mount inductor 100 as seen from a top surface side, which is on the opposite side from a mounting surface side of the surface mount inductor 100, and FIG. 2 is a schematic perspective view as seen from the mounting surface side. FIG. 3 is a schematic partial transparent plan view as seen from the top surface side and illustrates an example of the internal structure of the surface mount inductor 100. FIGS. 4A1 to 4C2 illustrate schematic plan views and schematic sectional views that are for schematically explaining a method of manufacturing the surface mount inductor 100.

As illustrated in FIGS. 1 to 3, the surface mount inductor 100 includes a molded body 10 that includes a composite material including a magnetic powder and in which a coil is buried; a pair of outer terminals 40 that are electrically connected to the coil; and a metal plate 30 that is arranged on a surface of the molded body 10. The molded body 10 has a bottom surface, which is a mounting surface, a top surface that faces the bottom surface and intersects a winding axis of the coil, and four side surfaces that are adjacent to the bottom surface and the top surface. The molded body 10 has a height, which is the distance between the bottom surface and the top surface, and a width, which is the distance between facing side surfaces. The molded body 10 has curved surface portions at corners of the molded body 10 where adjacent side surfaces intersect each other. The metal plate 30 includes a top surface portion that is arranged on the top surface of the molded body, side surface portions that are arranged on side surfaces of the molded body, and auxiliary portions that are arranged on the bottom surface of the molded body. The metal plate 30 is arranged so as to extend along the top surface of the molded body 10, along a pair of side surfaces of the molded body 10 that are adjacent to the top surface and face each other, and along parts of the bottom surface of the molded body 10. The top surface portion of the metal plate 30 constitutes a metal surface that intersects a winding axis of the coil. The top surface portion of the metal plate 30 has a shape and a size so as to cover the top surface up to the four edges of the top surface of the molded body 10 and so as to have cut-out portions at positions corresponding to the four corners of the top surface. Furthermore, the surface of the metal plate 30 is partially buried in the thickness direction thereof such that the surface of the metal plate 30 is exposed at the top surface and the side surfaces of the molded body 10, and parts of end surfaces 31 of the top surface portion are exposed from the side surfaces of the molded body 10. The width of the side surface portions of the metal plate 30 is smaller than the width of the molded body 10 between the side surfaces of the molded body 10 on which the outer terminals are arranged and molded body exposed portions are formed on the side surfaces on which the metal plate 30 is arranged. Furthermore, the metal plate 30 has, at the bottom surface sides of the side surface portions, auxiliary portions 32 that are arranged so as to extend from the side surfaces of the molded body 10 onto the bottom surface of the molded body 10. The auxiliary portions 32 are formed so as to have a smaller width than the side surface portions of the metal plate 30 and are partially buried in the bottom surface of the molded body 10 such that the surfaces of the auxiliary portions 32 are exposed. As a result of the metal plate 30 having the auxiliary portions 32 that are partially buried in the bottom surface of the molded body 10, close contact between the metal plate 30 and the molded body 10 is further improved and the mechanical strength of the surface mount inductor 100 is further improved.

The outer terminals 40 are arranged so as to extend from the pair of side surfaces of the molded body 10 on which the metal plate 30 is not arranged onto the bottom surface of the molded body 10. The height of the outer terminals 40 on the side surfaces is smaller than the height of the molded body 10 and the width of the outer terminals 40 on the side surfaces is smaller than the width of the molded body 10. The outer terminals 40 are arranged at positions and have sizes so as to not contact the metal plate 30 and the auxiliary portions 32.

As illustrated in FIG. 3, a coil 20 is buried inside the molded body such that a winding axis of the coil 20 intersects the top surface and the bottom surface of the molded body. The coil 20 includes a wound portion 22 formed by winding a substantially rectangular cross-section conductor having an insulating coating (hereafter, referred to as a "flat wire") in two stages such that the two end portions thereof are located at the outer periphery and such that the two stages are connected to each other at the inner periphery, and includes a pair of extending portions 24 that extend from the outermost periphery of the wound portion 22. The extending portions 24 extend toward the side surfaces of the molded body on which the metal plate is not arranged, the surfaces of the conductor of the extending portions 24 are exposed from the side surfaces of the molded body and are electrically connected to the outer terminals 40. Examples of the material of the insulating coating of the conductor include polyurethane resin, polyester resin, epoxy resin, and polyamide-imide resin. In FIG. 3, the metal plate 30 is arranged on the top surface of the molded body so as to intersect the winding axis of the coil and molded body exposed portions 12 are formed at the four corners of the top surface.

The molded body is formed using a composite material including a magnetic powder by performing pressure molding so as to have dimensions in a range from L 7.0 mm×W 7.0 mm×T 3.0 mm to L 12.0 mm×W 12.0 mm×T 6.0 mm. The composite material may further contain an adhesive such as a resin in addition to the magnetic powder. As examples of the magnetic material included in the composite material, iron (Fe), an iron-based metal magnetic powder such as Fe—Si, Fe—Si—Cr, Fe—Si—Al, Fe—Ni—Al, or Fe—Cr—Al, a metal magnetic powder having a composition that does not contain iron, a metal magnetic powder having another composition that does not contain iron, a metal magnetic powder having another composition that contains iron, an amorphous metal magnetic powder or the like, a metal magnetic powder in which the surfaces of the powder particles are coated with an insulator such as glass, a metal magnetic powder in which the surfaces of the powder particles have been modified, a nano-level very-fine metal magnetic powder, ferrite, and so forth can be given. Furthermore, as example of the adhesive, thermally curable resins such as epoxy resin, polyimide resin, and phenol resin, thermoplastic resins such as polyethylene resin and polyamide resin, and so forth can be given. Any of the above adhesives may be used on its own or two or more of the adhesives may be mixed together and used. Furthermore, it is sufficient that the metal plate 30 be formed of a conductive metal and for example the metal plate 30 may be formed of a conductor such as copper or nickel. The thickness of the metal plate 30 can be set to lie in a range from 100 μm to 300 μm, for example.

In the surface mount inductor 100, as a result of the molded body having the metal surface that intersects the winding axis of the coil, electric field noise and magnetic field noise generated by the coil can be blocked and radiation noise from the surface mount inductor is reduced. In the surface mount inductor 100, the metal plate constituting the metal surface closely contacts the molded body, and as a result noise leakage is less likely to occur. Furthermore, since the molded body and the metal plate are molded so as to be integrated with each other, the position of the metal plate is stabilized. Thus, degradation of a withstand voltage characteristic caused by there being an insufficient distance between the metal plate and the outer terminals due to a shift in the position of the metal plate is unlikely to occur.

The surface mount inductor 100 is, for example, manufactured by molding the coil, the composite material in which the coil is buried, and the metal plate having a prescribed shape in a state where the surface of the metal plate is exposed such that the molded body and the metal plate functioning as a shield are integrated with each other. An example of a method of manufacturing the surface mount inductor 100 will be described while referring to FIGS. 4A1 to 4C2. FIGS. 4A1, 4B1, and 4C1 are schematic plan views seen from an opening of a mold, and FIGS. 4A2, 4B2, and 4C2 are schematic sectional views taken along line A-A in FIGS. 4A1, 4B1, and 4C1.

In FIGS. 4A1 and 4A2, the metal plate 30, which has a prescribed shape, is arranged inside a mold 50. The metal plate 30 includes the top surface portion that is arranged on the top surface of the molded body, the side surface portions that are respectively arranged so as to be substantially perpendicular to the top surface portion at two facing edges of the top surface portion, and the auxiliary portions 32 that are respectively arranged at edges of the side surface portions on the opposite side from the top surface portion. The top surface portion of the metal plate 30 has cut-out portions 34 at positions corresponding to the four corners of the top surface of the molded body and the top surface portion covers the top surface of the molded body. The side surface portions have a smaller width than the top surface of the molded body and have substantially the same height as the molded body. The auxiliary portions 32 have a smaller width than the side surface portions and are arranged in the same planes as the side surface portions. In other words, the metal plate 30 is able cover the top surface of the molded body and a pair of side surfaces of the molded body that are adjacent to the top surface and face each other and has a shape in which the cut-out portions 34 are provided at positions corresponding to the four corners of the top surface of the molded body and in which the auxiliary portions 32 are provided at parts of the side surfaces of the molded body on the bottom surface side, and the metal plate 30 is processed so as to able to extend along the top surface and the pair of side surfaces of the molded body.

In FIGS. 4B1 and 4B2, a first preliminary molded body 60 and the coil 20 are arranged inside the mold 50 in which the metal plate has been arranged. The first preliminary molded body 60 is formed by preliminarily molding a composite material including a resin and a magnetic powder. The first preliminary molded body 60 includes a bottom portion 62 on which the wound portion 22 of the coil 20 is placed, a winding axis portion 68 that is arranged on the bottom portion 62 and is inserted into an inner peripheral space of the wound portion 22, and wall portions 64 that are arranged on outer edge portions of the bottom portion 62 and surround the wound portion 22. Cut-out portions 66 are respectively provided in parts of a pair of wall portions 64 that face each other. The bottom portion 62 of the first preliminary molded body 60 is arranged on the top surface portion of the metal plate and the side surface portions of the metal plate are sandwiched between the wall portions 64 and the inner walls of the mold 50. The auxiliary portions 32 of the metal plate are arranged at higher positions than the end surfaces of the wall portions 64 of the first preliminary molded body 60. The coil 20 is arranged such that the winding axis portion 68 is inserted into the space inside the wound portion 22 of the coil 20 and the extending portions 24 of the coil 20 extend to outside the first preliminary molded body 60 via the cut-out portions 66 of the wall portions 64 and are sandwiched between the wall portions 64 and the inner walls of the mold 50.

In FIGS. 4C1 and 4C2, a substantially flat-plate-shaped second preliminary molded body 70 is arranged on the first preliminary molded body, in which the coil 20 is surrounded by the bottom portion and the wall portions, and covers the first preliminary molded body and the coil 20. The auxiliary portions 32 of the metal plate are arranged so as to protrude from the second preliminary molded body 70.

Next, a punch is inserted from the opening side of the mold and the metal plate, the first preliminary molded body, the coil, and the second preliminary molded body are pressed and molded so as to be integrated with each other. Thus, the coil is buried in the molded body and the metal plate is buried in the thickness direction thereof with the surface of the metal plate exposed in the top surface of the molded body and at a pair of side surface of the molded body that are adjacent to the top surface of the molded body and face each other. Once the molding has been performed, the auxiliary portions of the metal plate are bent along the bottom portion of the molded body and are buried in the bottom portion with the surfaces thereof exposed from the bottom portion. Furthermore, the surfaces of the extending portions of the coil are respectively exposed at the side surfaces of the molded body where the metal plate is not arranged. In addition, the molded body exposed portions where the surface of the molded body is exposed are formed at positions corresponding to cut-out portions of the metal plate.

Next, an insulating coating is peeled off exposed portions of the extending portions of the coil. Then, for example, a conductive paste is applied to the side surfaces and the bottom surface of the molded body, in which the metal plate is partially buried, the surfaces of the conductor of the extending portions of the coil being exposed at the side surfaces, in order to form outer terminals that extend along the side surfaces and bottom surface of the molded body and are electrically connected to the extending portions of the coil. Thus, the surface mount inductor 100 is manufactured.

In FIGS. 4B1 and 4B2, the coil and the first preliminary molded body formed of a composite material are arranged inside the mold, but alternatively a composite material, which has not been subjected to preliminary molding, and the coil may be arranged inside a mold in which the metal plate has been arranged. In FIGS. 4C1 and 4C2, the second preliminary body formed of a composite material is arranged on top of the first preliminary molded body and the coil, but alternatively the inside of the mold may be filled with a composite material that has not been subjected to preliminary molding.

Example 2

Figure 5:
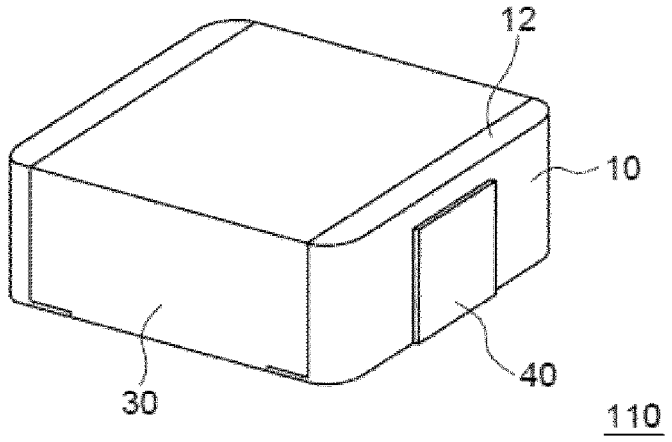
FIG. 5 is a schematic perspective view of a surface mount inductor of example 2 as seen from a top surface side.

A surface mount inductor 110 of example 2 will be described while referring to FIG. 5. FIG. 5 is a schematic perspective view of the surface mount inductor 110 as seen from a top surface side. The surface mount inductor 110 has substantially the same configuration as the surface mount inductor 100 of example 1 except that the top surface portion of the metal plate 30 arranged on the top surface of the molded body 10 does not extend up to the side surfaces of the molded body 10 on which the outer terminals 40 are arranged and molded body exposed portions 12 are continuously formed on the pair of side surfaces and the top surface of the molded body 10 on which the metal plate 30 is arranged.

In the surface mount inductor 110, the width of the top surface portion of the metal plate 30 is smaller than the width of the molded body 10 between the side surfaces of the molded body 10 on which the outer terminals are arranged. In addition, end surfaces of the metal plate 30 that face the side surfaces of the molded body 10 on which the outer terminals 40 are arranged are buried in the top surface of the molded body 10. Thus, the length of the part where the metal plate 30 is buried in the molded body 10 is increased and the mechanical strength of the surface mount inductor 110 is improved. Furthermore, the distance between the metal plate 30 and the outer terminals 40 is increased and the voltage withstand characteristic is improved.

Example 3

Figure 6:
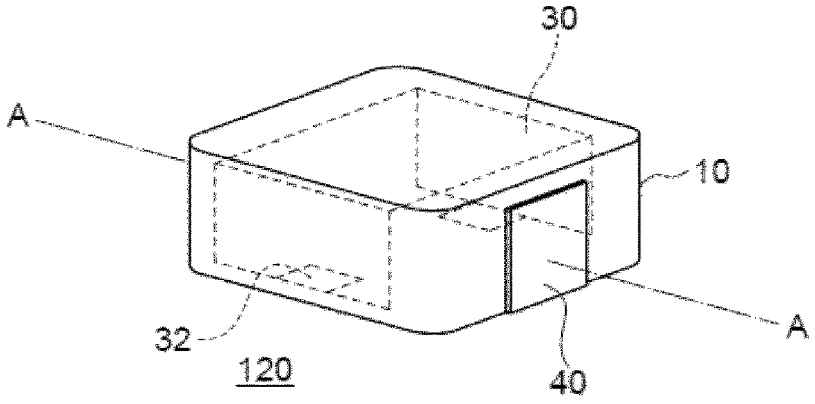
FIG. 6 is a schematic partial transparent perspective view of a surface mount inductor of example 3.
Figure 7:
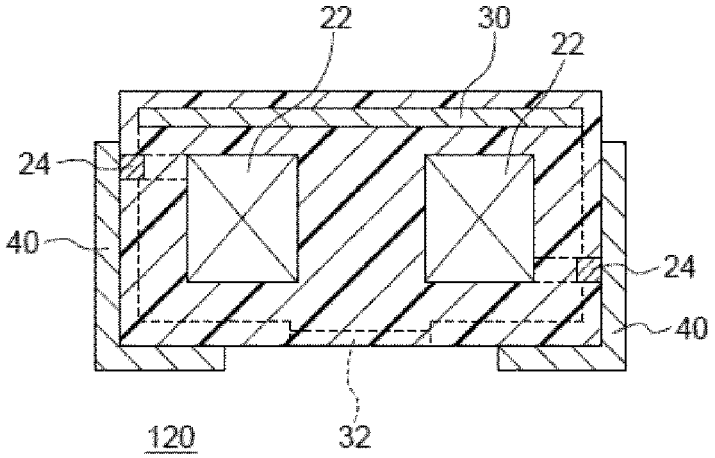
FIG. 7 is a schematic sectional view taken along line A-A in FIG. 6.

A surface mount inductor 120 of example 3 will be described while referring to FIGS. 6 to 8. FIG. 6 is a schematic partial transparent perspective view of the surface mount inductor 120 as seen from the top surface side and FIG. 7 is a schematic sectional view along a plane that is perpendicular to the top surface of the molded body taken along line A-A in FIG. 6. FIGS. 8A1 to 8C2 illustrate schematic plan views and schematic sectional views that are for schematically explaining a method of manufacturing the surface mount inductor 120. The surface mount inductor 120 has substantially the same configuration as the surface mount inductor 110 of example 2 except that the top surface portion and the side surface portions of the metal plate 30 are buried in the molded body 10 and the surfaces of the top surface portion and the side surface portions of the metal plate 30 are not exposed from the molded body.

As illustrated in FIGS. 6 and 7, in the surface mount inductor 120, the coil and the metal plate 30, which is arranged along the top surface of the molded body 10 and a pair of side surfaces of the molded body 10 that are adjacent to the top surface and face each other, are buried inside the molded body 10. The width of the metal plate 30 is smaller than the width of the molded body 10 between the side surfaces of the molded body 10 on which the outer terminals 40 are arranged. The top surface portion of the metal plate 30 that is arranged along the top surface of the molded body 10 may have substantially the same surface area as the top surface of the molded body 10 and the side surface portions of the metal plate 30 arranged along the side surfaces of the molded body 10 may have substantially the same surface areas as the side surfaces of the molded body 10. In addition, auxiliary portions 32, which are arranged along the bottom surface and extend away from facing side surfaces, are provided at the bottom surface sides of the side surface portions of the metal plate 30, which are buried along the side surfaces. The surfaces of the auxiliary portions 32 are exposed from the bottom surface of the molded body 10 and have a smaller width than the metal plate 30. The surfaces of the extending portions 24 that extend from the wound portion 22 of the coil are exposed from the side surfaces of the molded body 10 on which the outer terminals 40 are arranged and are electrically connected to the outer terminals 40. The surface mount inductor 120 is excellent in terms of close contact between the molded body 10 and the metal plate 30 and the mechanical strength of the surface mount inductor 120 is improved.

For example, the surface mount inductor 120 is manufactured by performing molding in a state where the coil and the metal plate, which is formed to have a size so as to be able to substantially cover the top surface of the molded body and a pair of side surfaces of the molded body that are adjacent to the top surface and face each other, and in which auxiliary portions are provided at the bottom surface sides of the side surface portions of the metal plate corresponding to the side surfaces of the molded body, are buried in the composite material constituting the molded body such that the molded body and the metal plate functioning as a shield are integrated with each other. An example of a method of manufacturing the surface mount inductor 120 will be described while referring to FIGS. 8A to 8C. FIGS. 8A1, 8B1, and 8C1 are schematic plan views seen from an opening of a mold, and FIGS. 8A2, 8B2, and 8C2 are schematic sectional views taken along line A-A in FIGS. 8A1, 8B1, and 8C1.

In FIGS. 8A1 and 8A2, a composite material 80 that includes a resin and a magnetic powder is arranged on the bottom surface of the mold 50. The composite material 80 may be preliminarily molded into a plate-like shape in advance. Next, the metal plate 30, which is formed with a size so as to be able to substantially cover the top surface of the molded body and a pair of side surfaces of the molded body that are adjacent to the top surface and face each other and which has the auxiliary portions 32 at the bottom surface sides of the side surface portions of the metal plate 30 corresponding to the side surfaces of the molded body, is processed so as to be able to extend along the top surface and the pair of side surfaces of the molded body, and is arranged on the composite material 80 inside the mold 50. At this time, an air gap or a composite material is provided in the spaces between the side surface portions of the metal plate 30, which correspond to the side surfaces of the molded body, and the inner walls of the mold 50.

In FIGS. 8B1 and 8B2, the first preliminary molded body 60 and the coil 20 are arranged inside the mold 50 in which the metal plate 30 has been arranged. The first preliminary molded body 60 is formed by preliminarily molding a composite material including a resin and a magnetic powder. The first preliminary molded body 60 includes a bottom portion 62 on which the wound portion 22 of the coil 20 is placed, a winding axis portion 68 that is arranged on the bottom portion 62 and is inserted into a space inside the wound portion 22, and wall portions 64 that are arranged on outer edge portions of the bottom portion 62 and surround the wound portion 22. Cut-out portions 66 are respectively provided in parts of a pair of wall portions 64 that face each other. The bottom portion 62 of the first preliminary molded body 60 is arranged on the top surface portion of the metal plate and the wall portions 64 are sandwiched between the side surface portions of the metal plate 30 and the coil 20. The auxiliary portions 32 of the metal plate are arranged at higher positions than the end surfaces of the wall portions 64 of the first preliminary molded body 60. The coil 20 is arranged such that the winding axis portion 68 is inserted into the space inside the wound portion 22 of the coil 20 and the extending portions 24 of the coil 20 extend to outside the first preliminary molded body 60 via the cut-out portions 66 and are sandwiched between the wall portions 64 and the inner walls of the mold 50.

In FIGS. 8C1 and 8C2, a substantially flat-plate-shaped second preliminary molded body 70 is arranged on the first preliminary molded body in which the coil 20 is surrounded by the bottom portion and the wall portions, and covers the first preliminary molded body and the coil 20. The auxiliary portions 32 of the metal plate 30 are arranged so as to be exposed from the second preliminary molded body 70.

Next, a punch is inserted from the opening side of the mold and the metal plate, the first preliminary molded body, the coil, and the second preliminary molded body are pressed and molded so as to be integrated with each other. Thus, the coil and the metal plate, which is arranged along the top surface of the molded body and the pair of side surfaces of the molded body that are adjacent to the top surface and face each other, are buried inside the molded body. Once the molding has been performed, the auxiliary portions of the metal plate are bent along the bottom portion of the molded body and are buried in the bottom portion with the surfaces thereof exposed from the bottom portion. Furthermore, the surfaces of the extending portions of the coil are respectively exposed at the side surfaces of the molded body where the metal plate is not arranged.

For example, a conductive paste is applied to the bottom surface of the molded body and the side surfaces of the molded body at which the surfaces of the extending portions of the coil are exposed in order to form outer terminals that extend along the side surfaces and bottom surface of the molded body and are electrically connected to the extending portions of the coil. Thus, the surface mount inductor 120 is manufactured.

In FIGS. 8B1 and 8B2, the coil and the first preliminary molded body formed of a composite material are arranged inside the mold, but alternatively a composite material, which has not been subjected to preliminary molding, and the coil may be arranged inside a mold in which the metal plate has been arranged. In FIGS. 8C1 and 8C2, the second preliminary body formed of a composite material is arranged on top of the first preliminary molded body and the coil, but alternatively the inside of the mold may be filled with a composite material that has not been subjected to preliminary molding.

Example 4

Figure 9:
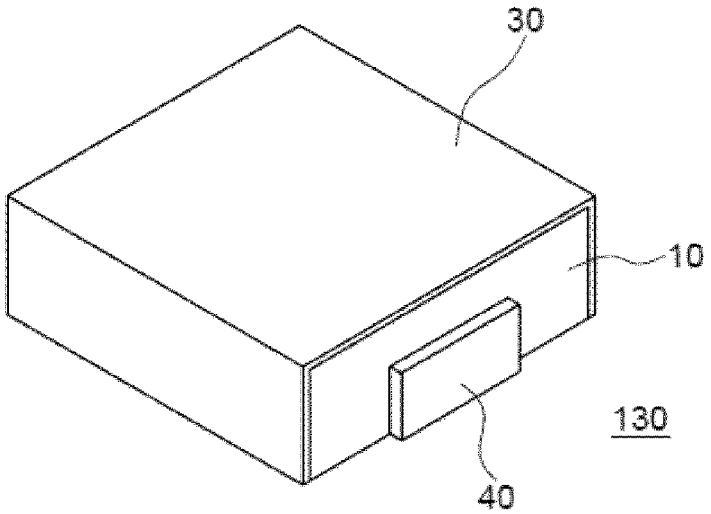
FIG. 9 is a schematic perspective view of a surface mount inductor of example 4 as seen from a top surface side.

A surface mount inductor 130 of example 4 will be described while referring to FIG. 9. FIG. 9 is a schematic perspective view of the surface mount inductor 130 as seen from a top surface side. The surface mount inductor 130 has substantially the same configuration as the surface mount inductor 100 of example 1 except that the metal plate 30, which is arranged on the top surface and the side surfaces of the molded body 10, extends up to the side surfaces of the molded body 10 on which the outer terminals 40 are arranged and end surfaces of the metal plate 30 are exposed from the side surfaces of the molded body 10, and the side surfaces of the molded body do not have curved surface portions and are instead perpendicular to adjacent side surfaces. Since a larger surface area is realized for the top surface portion of the metal plate 30 in the surface mount inductor 130, radiation noise from the inductor is suppressed to a greater degree.

Example 5

Figure 10:
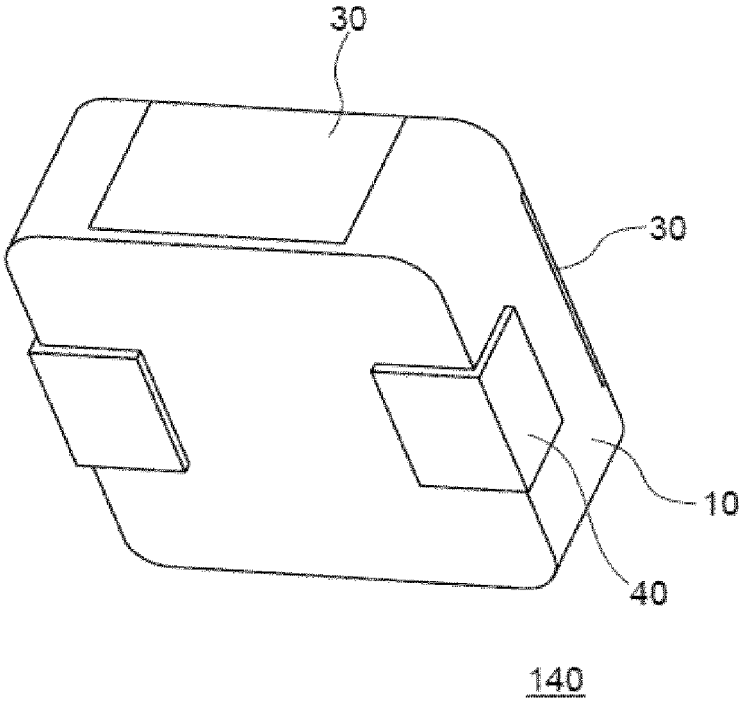
FIG. 10 is a schematic perspective view of a surface mount inductor of example 5 as seen from a mounting surface side.

A surface mount inductor 140 of example 5 will be described while referring to FIG. 10. FIG. 10 is a schematic perspective view of the surface mount inductor 140 as seen from a mounting surface side. The surface mount inductor 140 has substantially the same configuration as the surface mount inductor 100 of example 1 except that the side surface portions of the metal plate 30 arranged on the side surfaces of the molded body 10 do not have auxiliary portions that are arranged along the bottom surface at the bottom surface sides of the side surface portions of the metal plate 30 and the end surfaces of the metal plate 30 facing the bottom surface of the molded body 10 are buried in the side surfaces of the molded body 10. In the surface mount inductor 140, as a result of the metal plate 30 not having auxiliary portions arranged on the bottom surface with the surfaces thereof exposed, the distance between the metal plate 30 and the outer terminals 40 is longer and a withstand voltage characteristic between the metal plate 30 and the outer terminals 40 is further improved, and additionally a defect in the degree of parallelism of the outer terminals 40 caused by the surfaces of auxiliary portions protruding beyond the surfaces of the outer terminals 40 does not occur.

Example 6

Figure 11:
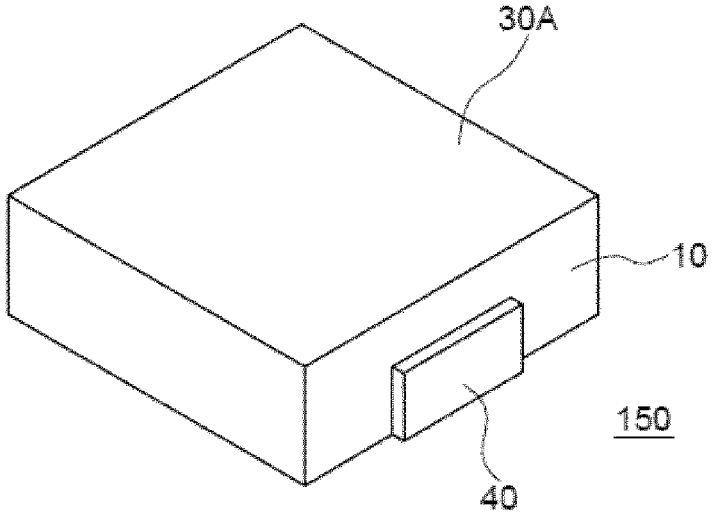
FIG. 11 is a schematic perspective view of a surface mount inductor of example 6 as seen from a top surface side.

A surface mount inductor 150 of example 6 will be described while referring to FIG. 11. FIG. 11 is a schematic perspective view of the surface mount inductor 150 as seen from a top surface side. The surface mount inductor 150 has substantially the same configuration as the surface mount inductor 100 of example 1 except that the metal surface that intersects the winding axis of the coil is formed of a metal film 30A, the metal film 30A, which is arranged on the top surface and side surfaces of the molded body 10, extends up to the side surfaces on which the outer terminals 40 are arranged, the metal film 30A does not have auxiliary portions that extend along the bottom surface of the molded body, and the side surfaces of the molded body do not have curved surface portions and are instead perpendicular to adjacent side surfaces. In addition, the surface mount inductor 150 has substantially the same configuration as the surface mount inductor 130 except that the metal film 30A is arranged on the top surface and the side surfaces of the molded body 10 instead of a metal plate and auxiliary portions that extend along the bottom surface of the molded body are not provided.

The metal film 30A formed on the molded body is formed of a conductive metal such as copper or nickel. The metal film may be formed of one layer or may be formed by stacking two or more layers. The thickness of the metal film can be set to lie in a range from 5 μm to 20 μm, for example. The metal film may be formed by performing sputtering, plating, or the like.

In the surface mount inductor 150 in which the metal surface is formed of a metal film, the thickness of the metal film functioning as a shield can be made small and the outer dimensions of the surface mount inductor 150 can be kept small. The molded body can be made larger and the dimensions of the coil can be made larger in line with the amount by which the thickness of the shield can be reduced. Furthermore, since there is no need to consider parts that are to be buried in the molded body, the surface area of the metal surface forming the shield can be increased.

The surface mount inductor 150 can be manufactured by forming a metal film on the surfaces of a molded body in which a coil is buried, for example. In addition, the surface mount inductor 150 can also be manufactured by forming a molded body in which a coil is buried by using a preliminary molded body composed of a composite material and having a metal film formed on surfaces thereof. An example of a method of manufacturing the surface mount inductor 150 will be described while referring to FIGS. 12A1 and 12A2, FIGS. 12B1 and 12B2, FIGS. 13A and 13B, and FIG. 14. FIGS. 12A1 and 12B1 are schematic plan views seen from an opening of a mold, and FIGS. 12A2 and 12B2 are schematic sectional views taken along line A-A in FIGS. 12A1 and 12A2.

In FIGS. 12A1 and 12A2, the first preliminary molded body 60 and the coil 20 are arranged inside the mold 50. The first preliminary molded body 60 is formed by preliminarily molding a composite material including a resin and a magnetic powder. The first preliminary molded body 60 includes a bottom portion 62 on which the wound portion 22 of the coil 20 is placed, a winding axis portion 68 that is arranged on the bottom portion 62 and is inserted into a space inside the wound portion 22, and wall portions 64 that are arranged on outer edge portions of the bottom portion 62 and surround the wound portion 22. Cut-out portions 66 are respectively provided in parts of a pair of wall portions 64 that face each other. The coil 20 is arranged such that the winding axis portion 68 is inserted into the space inside the wound portion 22 of the coil 20 and the extending portions 24 of the coil 20 extend to outside the first preliminary molded body 60 via the cut-out portions 66 and are sandwiched between the wall portions 64 and the inner walls of the mold 50.

In FIGS. 12B1 and 12B2, a substantially flat-plate-shaped second preliminary molded body 70 is arranged on the first preliminary molded body in which the coil 20 is surrounded by the bottom portion and the wall portions, and covers the first preliminary molded body and the coil 20.

Figure 13A:
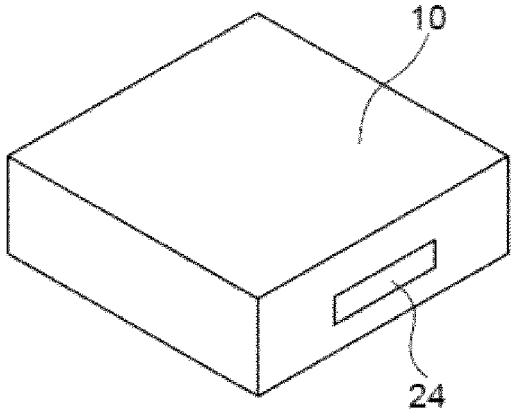
FIGS. 13A and 13B are schematic perspective views for explaining a method of manufacturing the surface mount inductor of example 6.

Next, a punch is inserted from the opening side of the mold and the first preliminary molded body, the coil, and the second preliminary molded body are pressed and molded so as to become integrated with each other. Thus, the coil is buried inside the molded body. Furthermore, the surfaces of the extending portions of the coil are respectively exposed at a pair of side surfaces of the molded body that face each other. As illustrated in FIG. 13A, the surfaces of the extending portions 24 of the coil are respectively exposed at the pair of facing side surface of the obtained molded body 10.

Figure 13B:
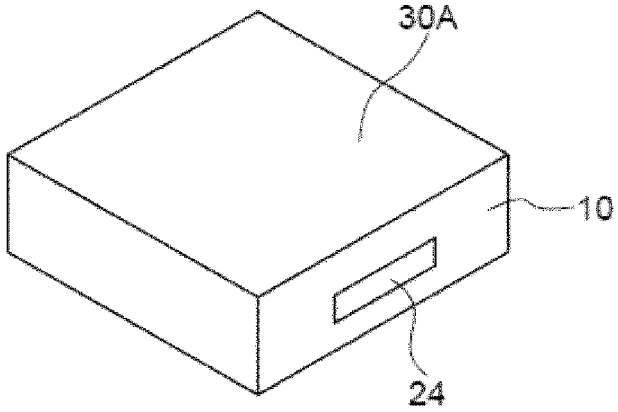

Next, the metal film is formed on the entirety of the top surface of the obtained molded body 10 and the entirety of the pair of side surfaces that are adjacent to the top surface and face each other by performing sputtering, plating, or the like using a conductive metal such as copper or nickel. Thus, as illustrated in FIG. 13B, the molded body 10 is obtained in which the metal film 30A is formed on the entirety of the top surface of the molded body 10 and the entirety of the pair of facing side surfaces of the molded body 10 at which the extending portions 24 of the coil are not exposed. The metal film 30A may be formed as one layer by performing sputtering, plating, or the like using a conductive metal such as copper or nickel. In addition, a metal film 30A may be formed in which a plurality of layers are stacked by forming a first layer by performing sputtering using nickel or the like and then forming a second layer by performing plating on the first layer using copper or the like, for example.

Next, a conductive paste is applied to the bottom surface of the molded body having the metal film formed on the surface thereof and the side surfaces of the molded body at which the surfaces of the extending portions of the coil are exposed in order to form outer terminals that extend from the side surfaces onto bottom surface of the molded body and are electrically connected to the extending portions of the coil. Thus, the surface mount inductor 150 is manufactured.

Figure 14:
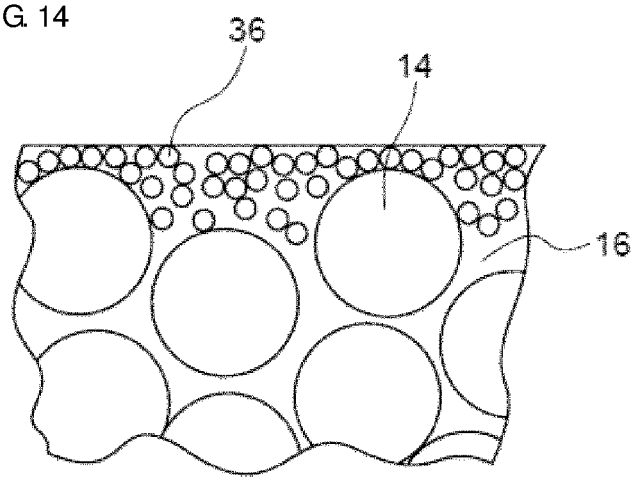
FIG. 14 is a schematic partial sectional view of the surface mount inductor of example 6.

In the method of manufacturing the surface mount inductor 150, the molded body may be arranged inside a mold and further molding processing may be performed after the metal film has been formed on the surfaces of the molded body and before forming the outer electrodes. Thus, for example, as illustrated in FIG. 14, at least part of a metal material 36 forming the metal film is buried inside the molded body that includes a magnetic powder 14 and a resin 16.

Furthermore, in the method of manufacturing the surface mount inductor 150, when forming the metal film 30A, the outer terminals may be formed by performing a step of forming outer terminals by performing a plating process. In addition, the shape of the metal film is not limited to a shape that extends over the entirety of the top surface and the entirety of the pair of side surfaces. For example, a metal film having the shape illustrated in the surface mount inductor 100 of example 1, the surface mount inductor 110 of example 2, or the surface mount inductor 140 of example 5 may also be formed on the molded body. In this case, the manufacturing method described in this example may be used.

Another example of a method of manufacturing the surface mount inductor 150 will be described while referring to FIGS. 15A1 and 15A2 and FIGS. 15B1 and 15B2. FIGS. 15A1 and 15B1 are schematic plan views seen from an opening of a mold, and FIGS. 15A2 and 15B2 are schematic sectional views taken along line A-A in FIGS. 15A1 and 15B1. In FIGS. 15A1 and 15A2, a first preliminary molded body 60A and the coil 20 are arranged inside the mold 50. The first preliminary molded body 60A is formed by preliminarily molding a composite material including a resin and a magnetic powder. The first preliminary molded body 60A includes a bottom portion 62 on which the wound portion 22 of the coil 20 is placed, a winding axis portion 68 that is arranged on the bottom portion 62 and is inserted into a space inside the wound portion 22, and wall portions 64 that are arranged on outer edge portions of the bottom portion 62 and surround the wound portion 22. Cut-out portions 66 are respectively provided in parts of a pair of wall portions 64 that face each other. A metal film 30B is provided on the outer surfaces of the wall portions 64 where the cut-out portions 66 are not provided and on the outer surface of the bottom portion 62 of the first preliminary molded body 60A. The metal film 30B may be formed by performing sputtering, plating, or the like using a conductive metal such as copper or nickel. The first preliminary molded body 60 is arranged such that the outer surfaces of the bottom portion 62 and the wall portions 64 face the inner surfaces of the mold 50. The coil 20 is arranged such that the winding axis portion 68 is inserted into the space inside the wound portion 22 of the coil 20 and the extending portions 24 of the coil 20 extend to outside the first preliminary molded body 60A via the cut-out portions 66 and are sandwiched between the wall portions 64 and the mold 50.

In FIGS. 15B1 and 15B2, a substantially flat-plate-shaped second preliminary molded body 70 is arranged on the first preliminary molded body in which the coil 20 is surrounded by the bottom portion and the wall portions, and covers the first preliminary molded body and the coil 20. The metal film 30B is formed on side surfaces of the second preliminary molded body 70 that contact the wall portions 64 of the first preliminary molded body 60A on which the metal film 30B is provided.

Next, a punch is inserted from the opening side of the mold and the first preliminary molded body, the coil, and the second preliminary molded body are pressed and molded so as to become integrated with each other. Thus, the coil is buried inside the molded body. Furthermore, the surfaces of the extending portions of the coil are respectively exposed at a pair of side surfaces of the molded body that face each other. In the obtained molded body, a metal film is formed on the top surface of the molded body and on the pair of side surfaces of the molded body that are adjacent to the top surface and face each other and at which the surfaces of the extending portions of the coil are not exposed. Next, in the same way as described above, outer terminals that are electrically connected to the extending portions of the coil are formed.

Example 7

Figure 16:
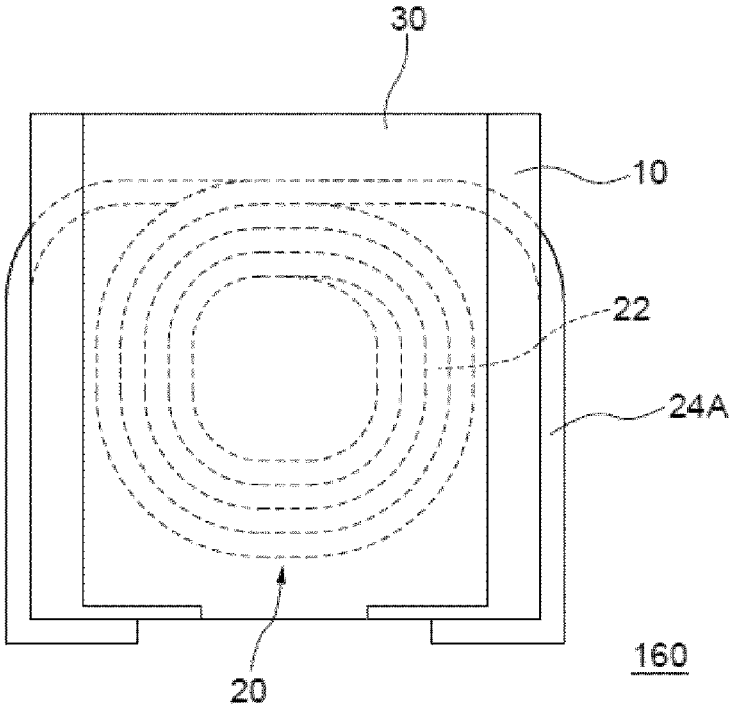
FIG. 16 is a schematic partial transparent plan view of a surface mount inductor of example 7.
Figure 17:
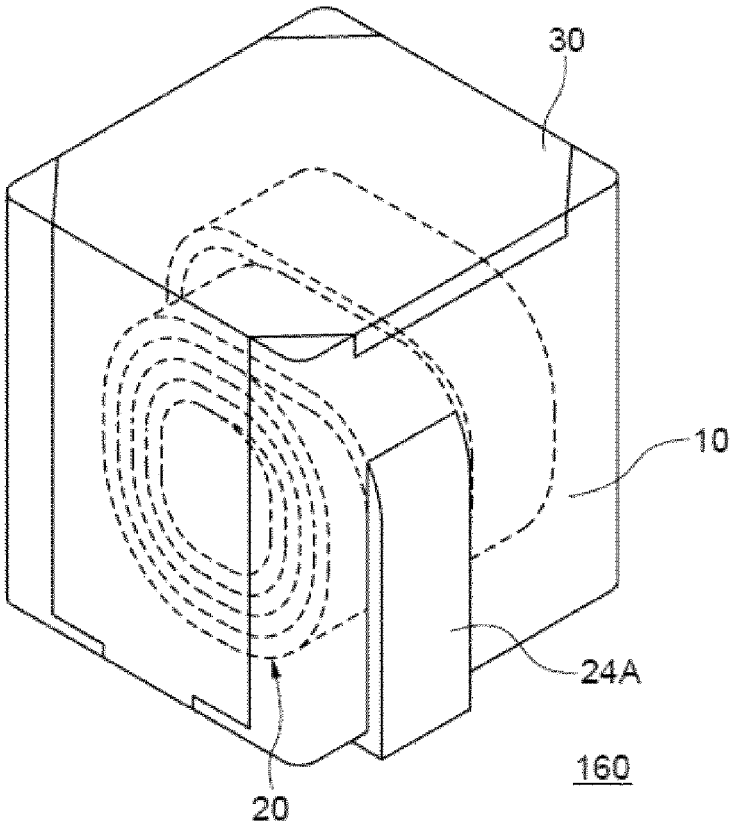
FIG. 17 is a schematic partial transparent perspective view of the surface mount inductor of example 7.

A surface mount inductor 160 of example 7 will be described while referring to FIGS. 16 and 17. FIG. 16 is a schematic partial transparent plan view of the surface mount inductor 160 as seen in an axial direction of the coil of the surface mount inductor 160 and FIG. 17 is a schematic partial transparent perspective view of the surface mount inductor 160 as seen from a top surface side. The surface mount inductor 160 has substantially the same configuration as the surface mount inductor 100 of example 1 except that the coil is arranged such that the winding axis of the coil does not intersect the bottom surface and top surface of the molded body 10 but rather intersects a pair of facing side surfaces of the molded body 10 and extending portions 24A of the coil form outer terminals.

As illustrated in FIGS. 16 and 17, in the surface mount inductor 160, the coil 20 is buried in the molded body 10 such that the winding axis of the wound portion 22 is substantially parallel to the bottom surface and the top surface of the molded body 10. End portions of the conductor forming the coil 20 respectively extend from the wound portion 22 to a pair of side surfaces that are substantially parallel to the winding axis. Extending portions 24A, which are exposed from the side surfaces, are arranged along the side surfaces and the bottom surface and form outer terminals. In addition, the molded body 10 has a metal plate 30 that is buried therein such that the surface of the metal plate 30 is exposed at the top surface of the molded body 10 and at the pair of side surfaces that are adjacent to the top surface and face each other and that are intersected by the winding axis of the wound portion 22. In other words, the molded body 10 has a metal surface that intersects the winding axis of the coil at a pair of side surfaces of the molded body 10. The metal plate 30 is formed of a conductive metal such as copper or nickel, covers the top surface and a pair of side surfaces that are adjacent to the top surface and face each other, and has cut-out portions that form molded body exposed portions 12 at the four corners of the top surface. In addition, the metal plate 30 has auxiliary portions (not illustrated) that extend onto the bottom surface from the bottom surface sides of side surface portions arranged on the side surfaces of the molded body 10. In the surface mount inductor 160, since the end portions of the extending portions 24A of the coil can be used as outer terminals, the number of components can be reduced and the manufacturing process can be simplified.

Example 8

Figure 18:
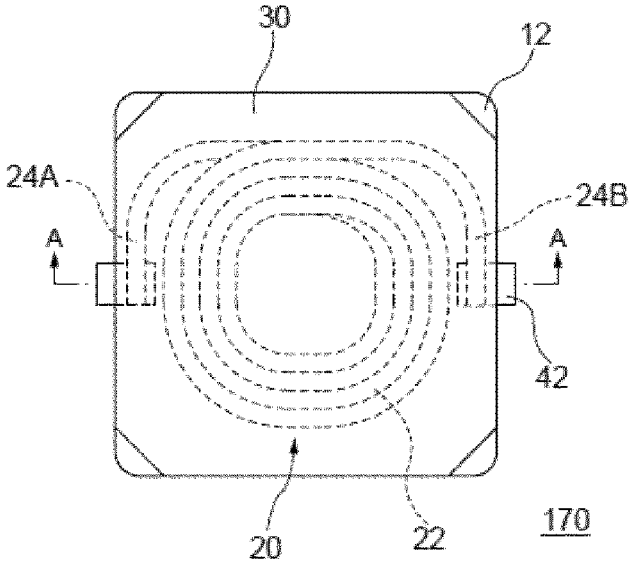
FIG. 18 is a schematic partial transparent plan view of a surface mount inductor of example 8.
Figure 19:
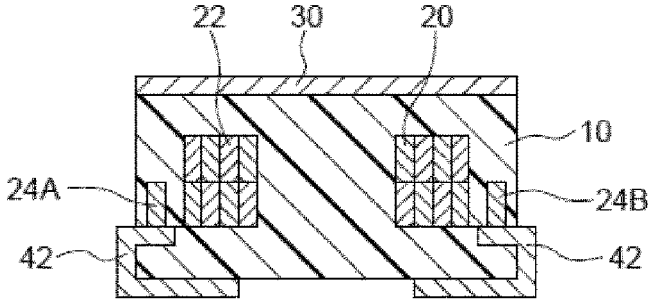
FIG. 19 is a schematic sectional view of the surface mount inductor of example 8.

A surface mount inductor 170 of example 8 will be described while referring to FIG. 18. FIG. 18 is a schematic partial transparent plan view of the surface mount inductor 170 as seen in an axial direction of the coil 20, and FIG. 19 is a schematic sectional view taken along line A-A in FIG. 18. The surface mount inductor 170 has substantially the same configuration as the surface mount inductor 100 of example 1 except that the surfaces of the extending portions 24 of the coil 20 are not exposed from the side surfaces of the molded body 10 and the surface mount inductor 170 includes metal plate terminals 42 that are electrically connected to the extending portions 24 and form outer terminals.

As illustrated in FIG. 18, in the surface mount inductor 170, the extending portions 24 of the coil 20 are buried in the molded body 10. The extending portions 24 are electrically connected to the metal plate terminals 42 inside the molded body 10. The metal plate terminals 42 each have one end that is exposed from a respective side surface of the molded body 10 and the metal plate terminals 42 extend from the side surfaces onto the bottom surface and form outer terminals. The metal plate terminals 42 are formed of a conductive metal such as copper or nickel. The metal plate terminals 42 include connection portions that are buried in the molded body 10, are electrically connected to the extending portions 24, and extend up to the side surfaces of the molded body, side surface portions that are formed so as to be continuous with the connection portions and are arranged along the side surfaces, and bottom surface portions that are formed so as to be continuous with the side surface portions and are arranged along the bottom surface. In other words, the side surface portions and the bottom surface portions of the metal plate terminals 42 form the outer terminals. As a result of the surface mount inductor 170 including the metal plate terminals, mounting reliability is improved.

Example 9

Figure 20:
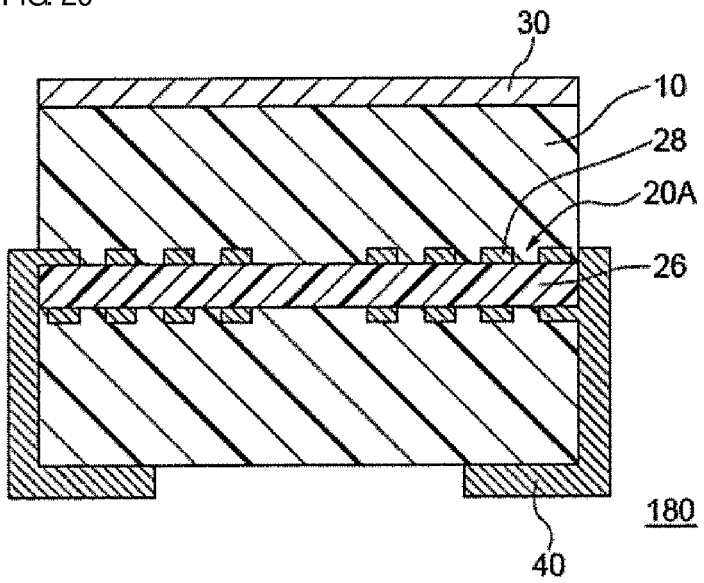
FIG. 20 is a schematic sectional view of a surface mount inductor of example 9.
Figure 21:
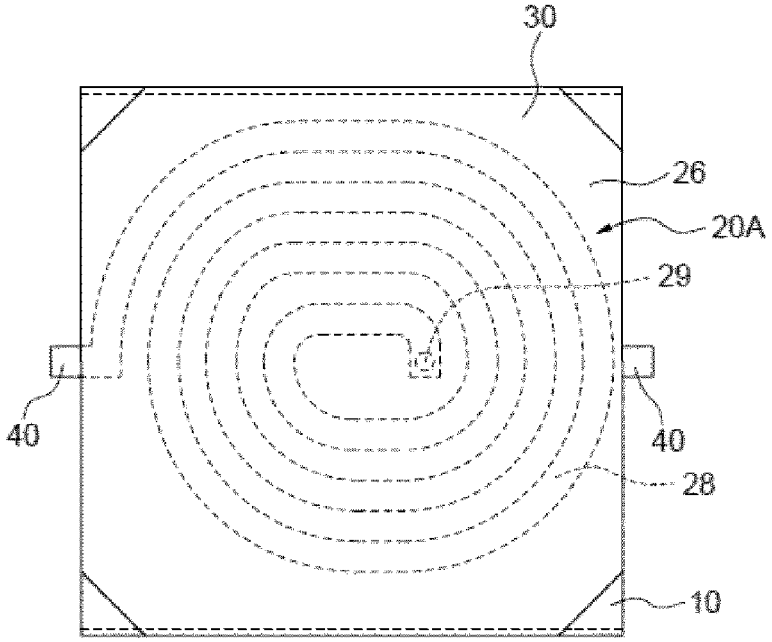
FIG. 21 is a schematic partial transparent plan view of the surface mount inductor of example 9.

A surface mount inductor 180 of example 9 will be described while referring to FIG. 20. FIG. 20 is a schematic sectional view of a cross section of the surface mount inductor 180 that is parallel to the winding axis of a coil 20A and passes through two outer electrodes. The surface mount inductor 180 has substantially the same configuration as the surface mount inductor 100 of example 1 except that the coil 20A, which is obtained by forming a conductor pattern 28 on a substrate 26, is buried in the molded body 10 instead of a coil formed of a wound conductor.

As illustrated in FIG. 20, in the surface mount inductor 180, the coil 20A is formed of the substrate 26 having the substantially helically shaped conductor pattern 28 formed on both surfaces thereof. In the coil 20A, the conductor patterns on the two surfaces are connected to each other via the substrate 26 at an inner peripheral portion of the conductor pattern 28 such that a continuous conductor pattern is formed. Outer peripheral end portions of the conductor pattern 28 extend from the side surfaces of the molded body 10 and are electrically connected to the outer terminals 40. The conductor pattern 28 is formed using a commonly used method such as applying a conductive paste, a photolithography method, or the like. In FIG. 20, the conductor pattern 28 is provided in two layers on both sides of the substrate 26, but the conductor pattern 28 may instead be provided in one layer on just one surface of the substrate 26, or the conductor pattern 28 may be instead be provided in three or more layers. Furthermore, the shape of the conductor pattern is not limited to a substantially helical shape and the conductor pattern may have another arbitrary shape such as a so-called meandering pattern. In the surface mount inductor 180, there is no need to wind a conductor to form a coil and processing of the extending portions is simple.

In the above-described examples, a coil that has a substantially circular wound portion obtained by winding a conductor in two stages such that both end portions thereof are located at the outer periphery and such that the two stages are connected to each other at the inner periphery is used as the coil, but another shape such as an oval shape, a rectangular shape, a track shape, an elliptical shape or the like may be used as the shape of the wound portion. Another winding method such as edge wise winding may be used as the winding method.

Furthermore, the conductor forming the coil is not limited to being a flat wire having a substantially rectangular cross section and may instead be a conductor having a substantially circular or square cross section.

An insulating layer may be further provided on the metal surface. The insulating layer provides an effect of suppressing oxidation of the metal surface and an effect of preventing shorts with the outer terminals.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface mount inductor comprising:

a coil that is buried in a composite material that includes a magnetic powder;

outer terminals that are connected to the coil; and a molded body that is formed of composite material and has a metal surface that intersects a winding axis of the coil and includes the composite material, wherein the metal surface is arranged such that at least part of the metal surface is exposed at a surface of the molded body, the metal surface is arranged on a top surface of the molded body, which is on an opposite side from a mounting surface side of the molded body, the metal surface has molded body exposed portions at at least two corners among four corners of the top surface, the metal surface has respective edges at the molded body exposed portions, with each edge respectively extending at an angle between a respective pair of adjacent side surfaces of the magnetic body to expose at least two corners of the top surface of the magnetic body, the metal surface is a surface of a metal plate, and the metal surface and the molded body exposed portions form the same surface.

2. The surface mount inductor according to claim 1, wherein the metal surface is arranged so as to extend along the top surface of the molded body, which is on the opposite side from the mounting surface side, and along a pair of side surfaces of the molded body that are adjacent to the top surface and face each other, and the metal surface has molded body exposed portions that are continuously formed on the top surface and the pair of side surfaces of the molded body.

3. The surface mount inductor according to claim 1, wherein the metal surface is buried inside the molded body.

4. The surface mount inductor according to claim 1, wherein the metal surface is a surface of a metal film formed on a surface of the molded body.

5. The surface mount inductor according to claim 4, wherein at least part of a metal material constituting the metal film is buried inside the molded body.

6. The surface mount inductor according to claim 2, wherein the metal surface is a surface of a metal plate.

7. The surface mount inductor according to claim 2, wherein the metal surface is a surface of a metal film formed on a surface of the molded body.

* * * * *